US009964084B2

(12) United States Patent
Wang et al.

(10) Patent No.: US 9,964,084 B2
(45) Date of Patent: May 8, 2018

(54) FUEL GUIDERAIL ASSEMBLY AND AN INTERNAL DAMPER HOLDER USED FOR THE FUEL GUIDERAIL ASSEMBLY

(71) Applicant: Continental Automotive GmbH, Hannover (DE)

(72) Inventors: Liang Wang, Changchun (CN); Jingying Liu, Changchun (CN); Jinpeng Xu, Changchun (CN); Guiyang Wu, Changchun (CN); Hailong Deng, Changchun (CN)

(73) Assignee: Continental Automotive Systems, Inc., Auburn Hills, MI (US)

( * ) Notice: Subject to any disclaimer, the term of this patent is extended or adjusted under 35 U.S.C. 154(b) by 380 days.

(21) Appl. No.: 14/423,508

(22) PCT Filed: Aug. 26, 2013

(86) PCT No.: PCT/IB2013/001842
§ 371 (c)(1),
(2) Date: Feb. 24, 2015

(87) PCT Pub. No.: WO2014/030056
PCT Pub. Date: Feb. 27, 2014

(65) Prior Publication Data

US 2015/0240767 A1 Aug. 27, 2015

(30) Foreign Application Priority Data

Aug. 24, 2012 (CN) ..... 2012 2 0425068 U

(51) Int. Cl.
*F02M 55/04* (2006.01)
*F02M 55/02* (2006.01)
(Continued)

(52) U.S. Cl.
CPC ..... *F02M 55/04* (2013.01); *F02M 55/02* (2013.01); *F02M 55/025* (2013.01);
(Continued)

(58) Field of Classification Search
CPC .... F02M 55/02; F02M 55/0225; F02M 55/04; F02M 69/465
(Continued)

(56) References Cited

U.S. PATENT DOCUMENTS 7,520,268 B1 4/2009 Sims, Jr.
2001/0042538 A1 11/2001 Rossi et al.
(Continued)

FOREIGN PATENT DOCUMENTS

WO 2008073515 A1 6/2008

OTHER PUBLICATIONS

International Search Report and the Written Opinion of the International Searching Authority dated Jan. 8, 1014.

*Primary Examiner* — Mahmoud Gimie

(57) ABSTRACT

A fuel guiderail assembly and an internal damper holder used for the fuel guiderail assembly. The fuel guiderail assembly comprises a fuel guiderail, a first end cap and a second end cap used to close the fuel guiderail, internal dampers, and a first internal damper holder and a second internal damper holder. The internal damper is provided with a first end and a second end. The first end and second end each comprise a main body and a raised part provided on the main body. The holders comprise a clamping part with a slit and a first holding part and a second holding part connected to the clamping part through the first elastic part and the second elastic part, respectively. Said first internal damper holder and second internal damper holder are respectively fixed by the first end cap and the second end cap, and the main bodies of the first end and the second end of the internal dampers are respectively enclosed in the slits of the
(Continued)

first internal damper holder and the second internal damper holder so that the internal dampers are prevented from moving in a first direction and a second direction. In addition, the raised parts on the main bodies are blocked by the clamping parts so that the internal dampers are prevented from moving in a third direction and are securely fixed inside the fuel guiderail.

19 Claims, 16 Drawing Sheets

(51) Int. Cl.
*F02M 69/46* (2006.01)
*F02M 61/14* (2006.01)
*F02M 61/16* (2006.01)

(52) U.S. Cl.
CPC ..... *F02M 61/145* (2013.01); *F02M 61/168* (2013.01); *F02M 69/465* (2013.01); *F02M 2200/09* (2013.01); *F02M 2200/315* (2013.01)

(58) Field of Classification Search
USPC ..... 123/456, 477, 457, 469
See application file for complete search history.

(56) References Cited

U.S. PATENT DOCUMENTS

| | | | | |
|---|---|---|---|---|
| 2003/0084878 | A1 | 5/2003 | Treusch et al. | |
| 2008/0087253 | A1 | 4/2008 | Cvengros et al. | |
| 2014/0283789 | A1* | 9/2014 | Bartell | F02M 55/025 123/456 |

* cited by examiner

FUEL GUIDERAIL ASSEMBLY AND AN INTERNAL DAMPER HOLDER USED FOR THE FUEL GUIDERAIL ASSEMBLY

CROSS REFERENCE TO RELATED APPLICATIONS

This is a U.S. national stage of application no. PCT/IB2013/001842, filed on Aug. 26, 2013, which claims priority to Chinese patent application no. 201220425068.0, filed Aug. 24, 2012, the content of both applications incorporated herein by reference.

TECHNICAL FIELD

The present utility model relates to a fuel guiderail assembly, and further to an internal damper holder used for the fuel guiderail assembly.

BACKGROUND ART

A fuel guiderail assembly is a device that distributes fuel from a fuel guiderail to an injector, which in turn injects the fuel into the air inlet duct of an engine. An injector is controlled by the injection instruction signals sent by the engine's Electronic Control Unit (ECU). When an injector injects fuel, the amount of fuel and the pressure in the fuel guiderail drop, causing pressure fluctuations in the fuel guiderail. Pressure fluctuations cause the fuel guiderail to vibrate and generate noises and affect the injection results of the injector. For an injector to deliver good injection results, the pressure in the fuel guiderail must be kept stable. A damper is a device used to stabilize the pressure in a fuel guiderail. Depending on the installation position, dampers can be classified into external dampers and internal dampers. An external damper is installed outside a fuel guiderail, and an internal damper is installed inside a fuel guiderail. The internal damper must be securely held in place inside the fuel guiderail, or else the damping effects of the damper are affected and noises are often generated when the engine is working.

SUMMARY OF UTILITY MODEL

To solve the technical problem, the present utility model provides a holder that can securely hold the internal damper in place inside the fuel guiderail.

Another objective of the present utility model is to provide a fuel guiderail assembly, said fuel guiderail assembly comprising an internal damper and a holder that can securely hold the internal damper in place inside the fuel guiderail.

To solve the problem stated above, the present utility model provides an internal damper holder, which comprises:

A clamping part provided with a slit;

A first holding part and a second holding part, which are fixedly connected to said clamping part through a first elastic part and a second elastic part, respectively, and are set on the same side of said clamping part, wherein said first holding part and second holding part can rotate through said first elastic part and second elastic part, respectively, and, in a direction away from said clamping part, the distance between said first holding part and second holding part tends to increase.

Optionally, said clamping part comprises a first clamping part.

Optionally, said clamping part comprises a first clamping part and a second clamping part that is fixedly connected to and in parallel with said first clamping part, wherein said first clamping part and second clamping part are both provided with a slit, and said first holding part and second holding part are fixedly connected to the first clamping part through the first elastic part and second elastic part, respectively.

Optionally, said clamping part further comprises a first spacing part and a second spacing part that are fixedly connected between said first clamping part and said second clamping part and are facing each other, and the spacing between said first spacing part and said second spacing part is equal to the width of said slit.

Optionally, said first elastic part and second elastic part are arch-shaped.

Optionally, the end of said first holding part and that of the second holding part are arch-shaped.

Optionally, said internal damper holder is an integrated and symmetrical butterfly structure.

To solve another problem mentioned above, on the basis of said internal damper holder, the present utility model further provides a fuel guiderail assembly, which comprises:

A fuel guiderail;

A first end cap and a second end cap that are fixed to both ends of said fuel guiderail;

An injector that is installed on said fuel guiderail and connected to the fuel guiderail;

An internal damper that is fixed inside said fuel guiderail, wherein said internal damper is provided with a first end and a second end, and said first end and second end comprise a main body and a raised part provided on the main body;

Internal damper holders which are used to hold said internal dampers in place inside said fuel guiderail, wherein there are two of said internal damper holders, the first and the second internal damper holders. The ends of the first holding part and second holding part of said first and second internal damper holders are respectively fixed inside said first end cap and second end cap. The first and second ends of said internal damper are respectively confined within the slits of the clamping parts of said first and second internal damper holders, and the raised parts of the first and second ends of said internal damper are blocked respectively by the clamping parts of said first and second internal damper holders.

Optionally, the lengths of the slits of said first and second internal damper holders are equal to the heights of the main bodies of said first end and second end. The widths of the slits of said first and second internal damper holders are equal to the thicknesses of the main bodies of said first end and second end.

Optionally, said raised parts are U-shaped, V-shaped, rectangular, or arch-shaped.

The fuel guiderail assembly disclosed by the present utility model comprises a fuel guiderail, a first end cap and a second end cap used to close the fuel guiderail, an internal damper fixed inside the fuel guiderail, and a first internal damper holder and a second internal damper holder used to fix the internal damper inside the fuel guiderail. Said internal damper is provided with a first end and a second end. Said first end and second end comprise a main body and a raised part provided on the main body. Said first and second internal damper holders each comprise a clamping part with a slit, and a first holding part and a second holding part separately connected to said clamping part through a first elastic part and second elastic part, respectively. Said first and second internal damper holders are fixed in place by the first and second end caps, respectively. The main bodies of the first and second ends of said internal damper are respectively enclosed in the slits of the first and second internal damper holders to prevent the internal dampers from moving in a first direction and a second direction. In addition, the raised parts on the first and second ends of the internal dampers are blocked by the clamping parts of the first and second internal damper holders respectively, thereby preventing the internal dampers from moving in a third direction so that the internal dampers can be securely fixed inside the fuel guiderail.

PARTICULAR EMBODIMENTS

The following clearly and completely describes the technical schemes used in the present utility model in conjunction with embodiments shown in accompanying drawings. Obviously, the described embodiments are only some, but not all, of the embodiments of the present utility model. All other embodiments obtained based on these embodiments by those skilled in the art without creative work shall fall within the protection scope of the present utility model.

Figure 1:
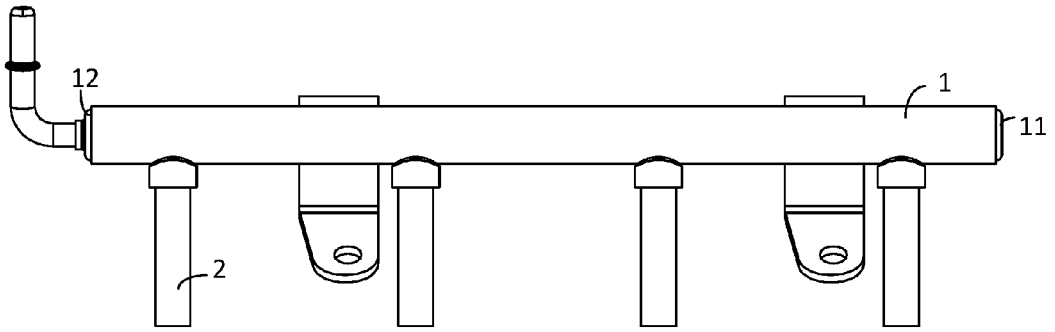
FIG. 1 is a schematic diagram of the fuel guiderail assembly of the present utility model.

FIG. 1 is a schematic diagram of the fuel guiderail assembly of the present utility model. As shown in FIG. 1, the fuel guiderail assembly comprises a fuel guiderail 1, a first end cap 11 and a second end cap 12 fixed to both ends of the fuel guiderail 1 to close the fuel guiderail 1, and an injector 2 installed on the fuel guiderail 1. The injector 2 is connected to the fuel guiderail 1 so that the fuel guiderail 1 can distribute fuel to the injector 2, which then injects the fuel into the air inlet duct (not shown) of an engine.

Figure 2:
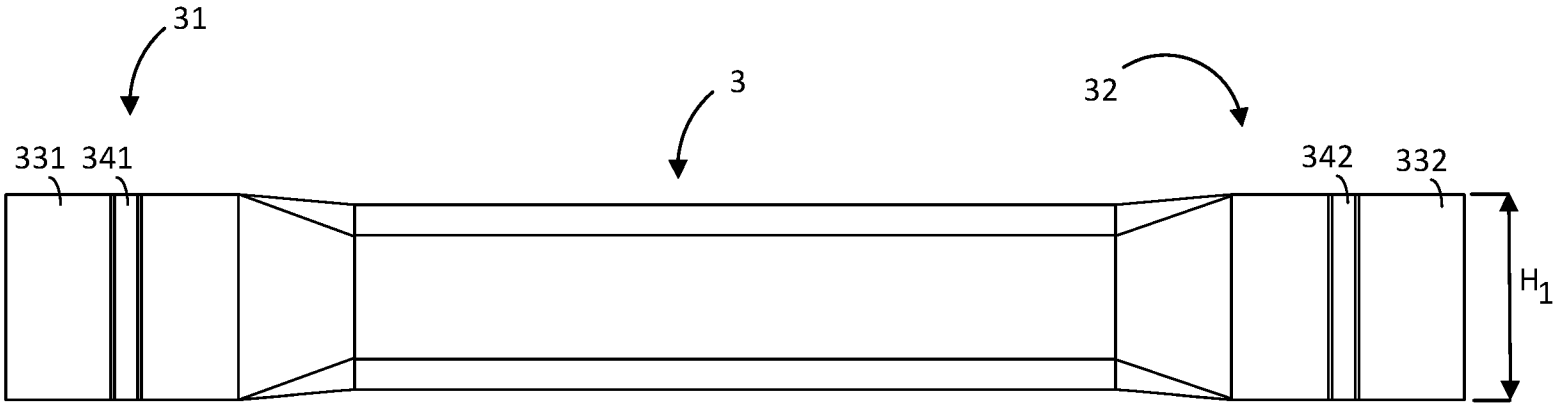
FIG. 2 and FIG. 3 show respectively the front view and top view of an internal damper used in the fuel guiderail assembly of the present utility model.
Figure 3:
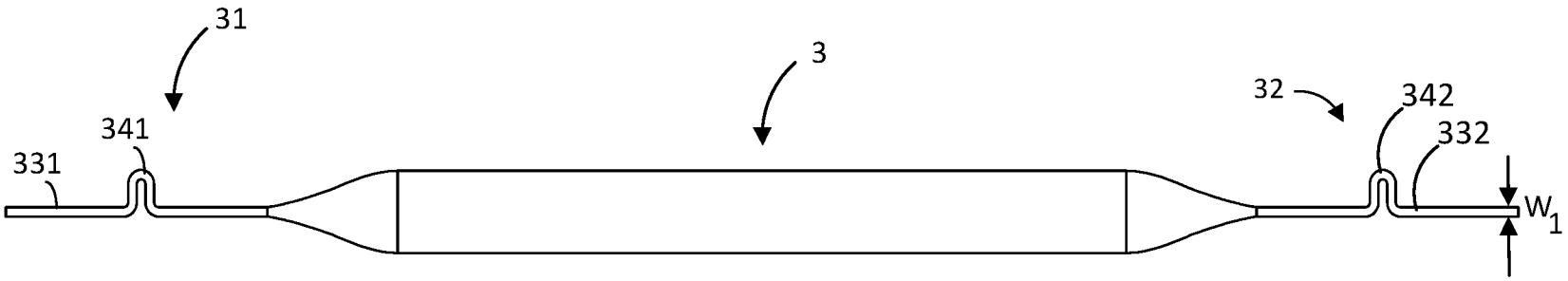

As mentioned above, the pressure in a fuel guiderail must be kept stable for an injector to deliver good injection results. To achieve this purpose, said fuel guiderail assembly further comprises a damper set inside said fuel guiderail, known as an internal damper. FIG. 2 and FIG. 3 are respectively the front view and top view of an internal damper in the fuel guiderail assembly of the present utility model. As shown in FIGS. 2 and 3, the internal damper 3 is a device with a volume that can be changed to adjust the pressure in the fuel guiderail 1. The internal damper 3 is provided with a first end 31 and a second end 32. The first end 31 comprises a main body 331 and a raised part 341 on the main body 331. The second end 32 comprises a main body 332 and a raised part 342 on the main body 332. In an embodiment, the raised parts 341 and 342 are U-shaped. In other embodiments, the raised parts 341 and 342 can take other shapes, for example, V-shape, rectangular shape, and arch shape. In an embodiment, the main body 331 of the first end and the main body 332 of the second end take the shape of a flat plate. The heights and widths of the main body 331 of the first end and the main body 332 of the second end are $H_1$ and $W_1$ respectively.

As shown in FIG. 1 to FIG. 3, to securely fix the internal damper 3 inside the fuel guiderail 1, said fuel guiderail assembly further comprises internal damper holders that are set inside the fuel guiderail 1. There are two internal damper holders, a first internal damper holder and a second internal damper holder. Said first internal damper holder and second internal damper holder are respectively fixed by the first end cap 11 and the second end cap 12 that are fixedly connected to the fuel guiderail 1. The first end cap 11 and the second end cap 12 are located at the two ends of the fuel guiderail 1. Under the combined action of the fixed first internal damper holder and the raised part 341 of the first end 31 and the combined action of the fixed second internal damper holder and the raised part 342 of the second end 32, the internal damper 3 does not move in any direction so the internal damper 3 is fixed inside the fuel guiderail 1.

By using three embodiments of said fuel guiderail, the following describes in detail the structure of the internal damper holder of the present utility model. Note that in each of the following embodiments, the structure of the first internal damper holder and that of the second internal damper holder are the same. However, in actual application, the structure of the first internal damper holder in a fuel guiderail assembly and that of the second internal damper holder can be different. In such a case, the two internal damper holders can be selected from the following embodiments.

First Embodiment of the Fuel Guiderail Assembly

Figure 4:
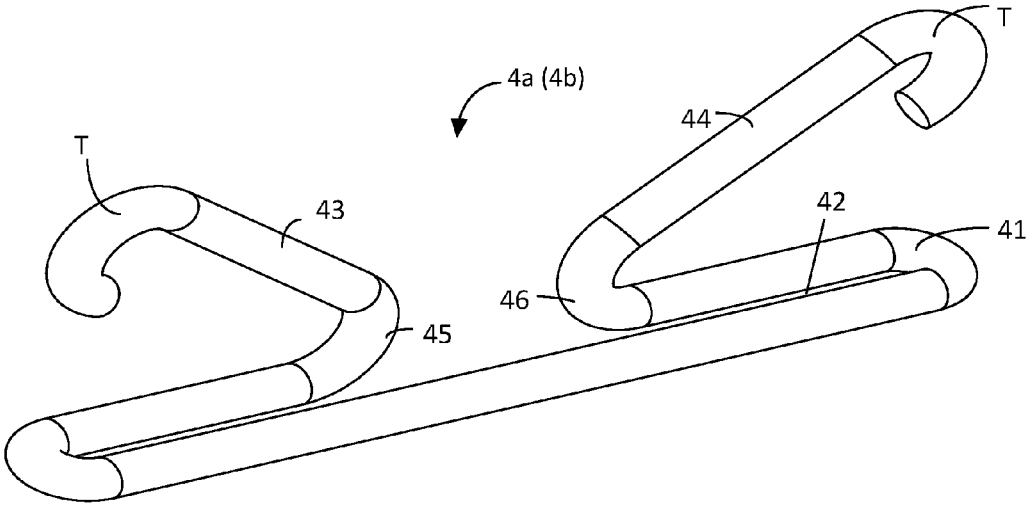
FIG. 4 shows the exploded view of the internal damper holder in the first embodiment of the fuel guiderail of the present utility model.
Figure 5:
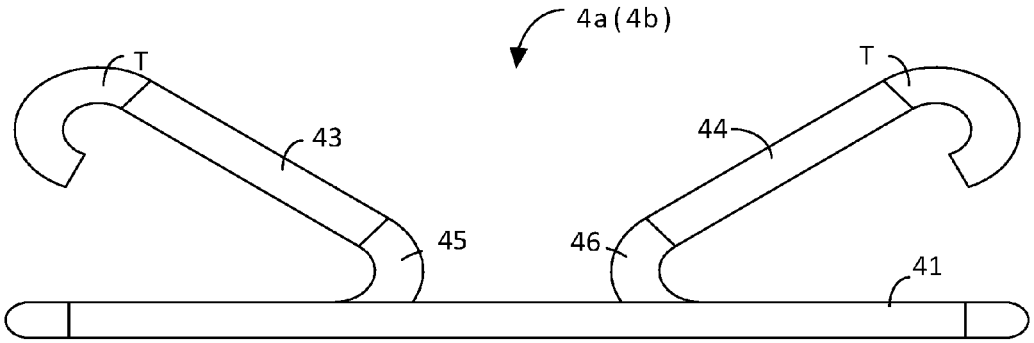
FIG. 5 is the front view of the internal damper holder shown in FIG. 4.
Figure 6:
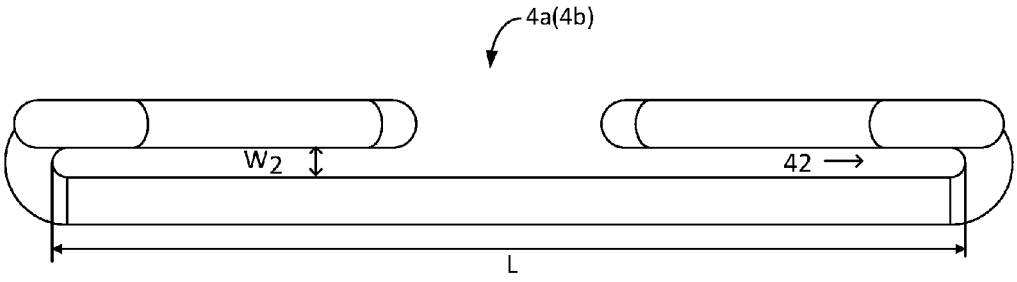
FIG. 6 is the top view of the internal damper holder shown in FIG. 4.
Figure 7:
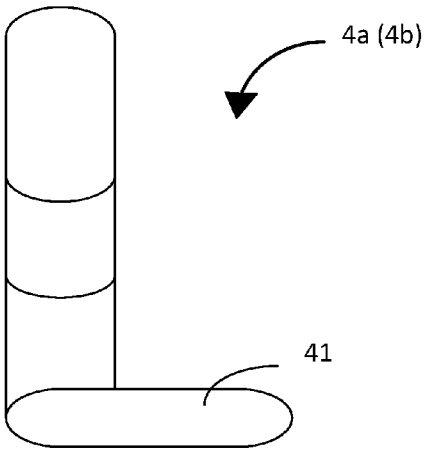
FIG. 7 is the left view of the internal damper holder shown in FIG. 4.
Figure 8:
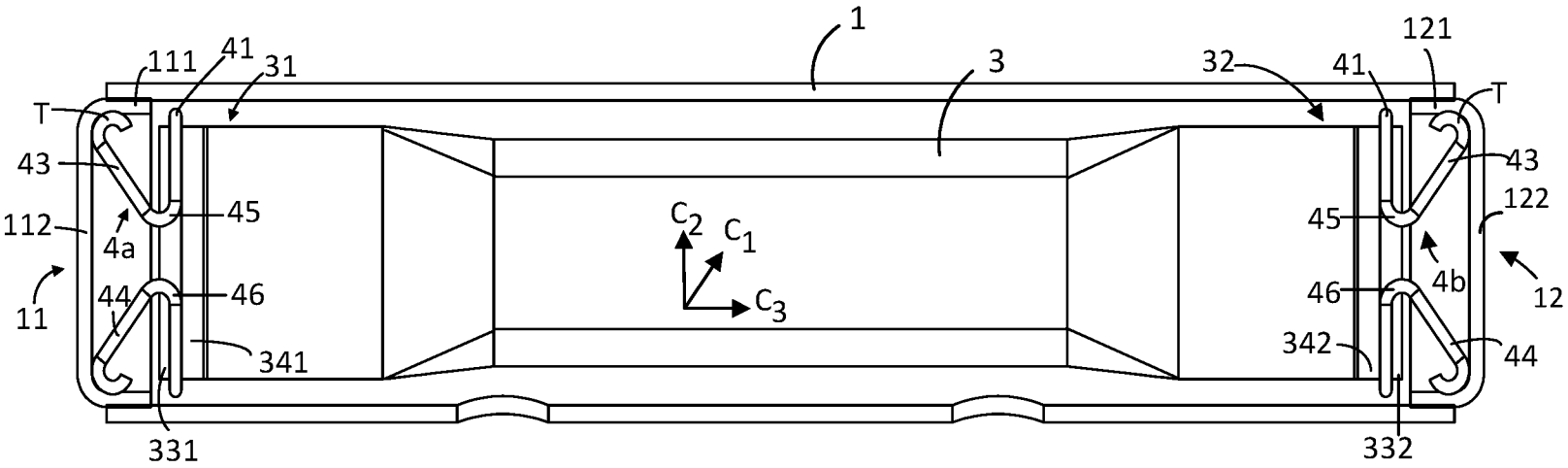
FIG. 8 and FIG. 9 are respectively the sectional view of fixing the internal damper shown in FIG. 2 and that shown in FIG. 3 inside a fuel guiderail by using the internal damper holder shown in FIG. 4.
Figure 9:
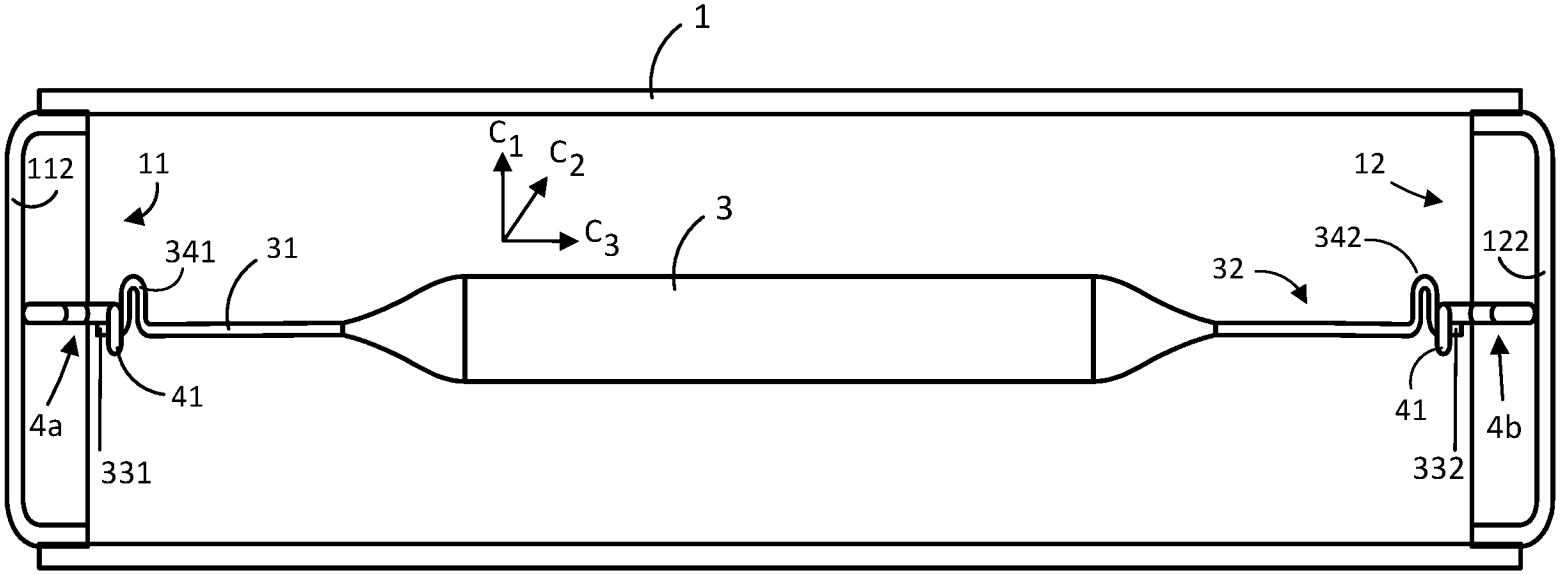

FIG. 4 is an exploded view of the internal damper holder in the first embodiment of the fuel guiderail of the present utility model. FIG. 5 is a front view of the internal damper holder shown in FIG. 4. FIG. 6 is a top view of the internal damper holder shown in FIG. 4. FIG. 7 is a left view of the internal damper holder shown in FIG. 4. FIG. 8 and FIG. 9 are respectively sectional views of fixing the internal damper shown in FIG. 2 and that shown in FIG. 3 inside a fuel guiderail by using the internal damper holder shown in FIG. 4. As shown in FIG. 2 to FIG. 9, the first internal damper holder 4*a* and the second internal damper holder 4*b* comprise a clamping part 41 with a slit 42, a first holding part 43 and a second holding part 44 fixedly connected to the clamping part 41. In the present embodiment, the clamping part 41 comprises only a first clamping part. Therefore, in the following description of the first embodiment, the clamping part 41 is the first clamping part and the slit 42 is the slit of the first clamping part.

When the internal damper 3 is fixed, the main body 331 of the first end and the main body 332 of the second end of the internal damper 3 pass through the slits 42 of the first internal damper holder 4*a* and the second internal damper holder 4*b*. To ensure that the internal damper 3 does not move in the first direction $C_1$ or the second direction $C_2$ (The first direction $C_1$ refers to the projective direction of the front view of the internal damper as shown in FIG. 2 and the direction opposite to the projective direction as shown in FIG. 2. The second direction $C_2$ refers to the projective direction of the top view of the internal damper as shown in FIG. 3 and the direction opposite to the projective direction as shown in FIG. 3) after the main body 331 of the first end and the main body 332 of the second end of the internal damper 3 pass through the slit 42, the length L of the slit 42 is equal to the height $H_1$ of the main body 331 of the first end and the main body 332 of the second end and the width $W_2$ of the slit 42 is equal to the width $W_1$ of the main body 331 of the first end and the main body 332 of the second end. In actual manufacture, the requirement that the length L of the slit 42 on an internal damper holder is equal to the height $H_1$ of the main body 331 of the first end and the main body 332 of the second end and the requirement that the width $W_2$ of the slit 42 is equal to the width $W_1$ of the main body 331 of the first end and the main body 332 of the second end cannot be met concurrently in certain cases. In such a case, the clamping part 41 can be squeezed manually to decrease the width $W_2$ of the slit 42 or pulled manually to increase the width $W_2$ of the slit 42, thereby limiting the internal damper 3 within the slits 42 of the first internal damper holder 4*a* and the second internal damper holder 4*b*.

The first holding part 43 and the second holding part 44 are fixedly connected to the clamping part 41 through the first elastic part 45 and the second elastic part 46, respectively. In addition, the first holding part 43 and the second holding part 44 are provided on the same side (the side away from the raised parts 341 and 342 as shown in FIG. 8 and FIG. 9) of the clamping part 41. In a direction away from the clamping part 41, the distance between the first holding part 43 and the second holding part 44 generally tends to increase. In this embodiment, the first holding part 43 and the second holding part 44 are provided in a V-shape on the same side of the clamping part 41. When an internal damper holder meets with no external action, the maximum distance between the end T of the first holding part 43 and the end T of the second holding part 44 is greater than the inner diameter of the fuel guiderail 1. The first elastic part 45 and the second elastic part 46 can be squeezed or pulled and become deformed. Therefore, under an external force, the first holding part 43 can rotate through the first elastic part 45, and the second holding part 44 can rotate through the second elastic part 46. When the first elastic part 45 and the second elastic part 46 are squeezed and deformed, the first holding part 43 and the second holding part 44 rotate towards the clamping part 41, and the first holding part 43 gradually moves away from the second holding part 44. When the first elastic part 45 and the second elastic part 46 are pulled and deformed, the first holding part 43 and the second holding part 44 rotate away from the clamping part 41, and the first holding part 43 gradually moves towards the second holding part 44.

In conjunction with FIG. 4, FIG. 8, and FIG. 9, the following describes a procedure of fixing an internal damper inside a fuel guiderail by using the first internal damper holder and the second internal damper holder in this embodiment:

Step 1 Make the main body 331 of the first end of the internal damper 3 pass through the slit 42 of the first internal damper holder 4*a* until the clamping part 41 is blocked by the raised part 341 on the first end 31.

Step 2 Secure the first end cap 11 to one end of the fuel guiderail 1 by soldering.

Step 3 Manually rotate the first holding part 43 and the second holding part 44 of the first internal damper holder 4*a* away from the clamping part 41 (rotate the first holding part 43 counter-clockwise and the second holding part 44 clockwise). During the rotation, the first elastic part 45 and the second elastic part 46 are pulled and deformed. In addition, under the action of said rotation, the first holding part 43 and the second holding part 44 gradually move towards each other. When the first holding part 43 and the second holding part 44 are sufficiently close to each other, the maximum distance between the end T of the first holding part 43 and the end T of the second holding part 44 is smaller than the inner diameter of the fuel guiderail 1. Stop the manual rotation of the first holding part 43 and the second holding part 44 so that the end T of the first holding part 43 and that of the second holding part 44 enter the other end (the end to be sealed up by the second end cap 12) of the fuel guiderail 1. During the rotation of the first holding part 43 and the second holding part 44, the first elastic part 45 and the second elastic part 46 are pulled and deformed. Therefore, a compressing force that restores the shape of the first elastic part 45 and that of the second elastic part 46 is generated in the first elastic part 45 and the second elastic part 46 respectively. When manual rotation of the first holding part 43 and the second holding part 44 is stopped, under said compressing force, the end T of the first holding part 43 and that of the second holding part 44 can be firmly held between the side walls of the fuel guiderail 1.

Step 4 Push the internal damper 3 so that it moves towards the first end cap 11. When the internal damper 3 is pushed, the raised part 341 on the first end 31 of the internal damper 3 exerts a force oriented to the first end cap 11 upon the clamping part 41 of the first internal damper holder 4*a*. Under said force, the end T of the first holding part 43 and that of the second holding part 44 can move along the side walls of the fuel guiderail 1, allowing the first internal damper holder 4*a* to move towards the first end cap 11: First, the entire first internal damper holder 4*a* enters the fuel guiderail 1. Then, the entire first internal damper holder 4*a* moves within the fuel guiderail 1. Finally, the first holding part 43 and the second holding part 44 of the first internal damper holder 4*a* enter the first end cap 11. On the one hand, the end T of the first holding part 43 and that of the second holding part 44 are blocked by the lower wall 112 of the first end cap 11, preventing the first internal damper holder 4*a* from moving any further. On the other hand, the end T of the first holding part 43 and that of the second holding part 44 are blocked by the side wall 111 of the first end cap 11. As mentioned above, because the first elastic part 45 and the second elastic part 46 are pulled and deformed, a compressing force that restores the shape of the first elastic part 45 and that of the second elastic part 46 is generated in the first elastic part and the second elastic part 46 respectively. Under said compressing force, the first holding part 43 and the second holding part 44 can be fixed inside the first end cap 11.

Step 5 Make the main body 332 of the second end of the internal damper 3 pass through the slit 42 of the second internal damper holder 4*b* until the clamping part 41 is blocked by the raised part 342 on the second end 32.

Step 6 Manually rotate the first holding part 43 and the second holding part 44 of the second internal damper holder 4*b* in directions away from the clamping part 41 (Rotate the first holding part 43 clockwise and the second holding part 44 counter-clockwise). During the rotation, the first elastic part 45 and the second elastic part 46 are pulled and deformed. In addition, under the action of said rotation, the first holding part 43 and the second holding part 44 gradually move towards each other. When the first holding part 43 and the second holding part 44 are sufficiently close to each other, the maximum distance between the end T of the first holding part 43 and the end T of the second holding part 44 is smaller than the inner diameter of the second end cap 12. Stop manually rotating the first holding part 43 and the second holding part 44 so that the end T of the first holding part 43 and that of the second holding part 44 enter the second end cap 12. During the rotation of the first holding part 43 and the second holding part 44, the first elastic part 45 and the second elastic part 46 are pulled and deformed. Therefore, a compressing force that restores the shape of the first elastic part 45 and that of the second elastic part 46 is generated in the first elastic part 45 and the second elastic part 46 respectively. When manual rotation of the first holding part 43 and the second holding part 44 is stopped, under said compressing force, the end T of the first holding part 43 and that of the second holding part 44 of the second internal damper holder 4*b* can be firmly held between the side walls 121 of the second end cap 12.

Step 7 Push the second end cap 12 so that it moves towards the first end cap 11. When the second end cap 12 is pushed, a force oriented to the first end cap 11 is exerted upon the second internal damper holder 4*b*. The clamping part 41 of the second internal damper holder 4*b* is blocked by the raised part 342 on the second end 32 of the internal damper 3. Therefore, under the combined action of said force and the raised part 342, the end T of the first holding part 43 and that of the second holding part 44 move along the side walls 121 of the second end cap 12 until the end T of the first holding part 43 and that of the second holding part 44 are blocked by the lower wall 122 of the second end cap 12. Meanwhile, the first holding part 43 and the second holding part 44 of the second internal damper holder 4*b* rotate towards the clamping part 41 (The first holding part 43 rotates counter-clockwise and the second holding part 44 rotates clockwise) until the second end cap 12 is fixed to the fuel guiderail 1. In addition, because the end T of the first holding part 43 and that of the second holding part 44 of the first internal damper holder 4*a* are blocked by the lower wall 112 of the first end cap 11, when the second end cap 12 is pushed, a force oriented to the first end cap 11 is exerted upon the first internal damper holder 4*a*. Under said force, the clamping part 41 of the first internal damper holder 4*a* moves towards the first end cap 11. Because one side of the first internal damper holder 4*a* is blocked by the lower wall 112 of the first end cap 11, the first elastic part 45 and the second elastic part 46 are compressed and deformed.

When the installation of the entire fuel guiderail assembly is complete, the first elastic part 45 and the second elastic part 46 of the first internal damper holder 4*a* and the second internal damper holder 4*b* fixed in the fuel guiderail 1 are compressed. When compressed, the first elastic part 45 and the second elastic part 46 of the second internal damper holder 4*b* exert a force oriented to the first end cap 11 upon the raised part 342 on the second end 32 of the internal damper 3. When compressed, the first elastic part 45 and the second elastic part 46 of the first internal damper holder 4*a* exert a force oriented to the second end cap 12 upon the raised part 341 on the first end 31 of the internal damper 3. The combined action of these two forces prevents the internal damper 3 from moving in the third direction $C_3$ (perpendicular to the first direction $C_1$ and the second direction $C_2$).

To ensure that the raised parts 341 and 342 completely block the clamping part 41 located on the same side as the raised parts 341 and 342 after the installation of the entire fuel guiderail assembly is completed, the raised parts 341 and 342 can be made higher than the clamping part 41 located on the same side as the raised parts 341 and 342.

As described above, after the installation of the entire fuel guiderail assembly is completed, the first internal damper holder 4*a* and the second internal damper holder 4*b* are respectively fixed by the first end cap 11 and the second end cap 12 fixedly connected to the fuel guiderail 1. In addition, the first end cap 11 and the second end cap 12 are provided on the two ends of the fuel guiderail 1. The length L of the slit 42 of the clamping part 41 of the first internal damper holder 4*a* is equal to the height $H_1$ of the main body 331 of the first end of the internal damper 3, and the width $W_2$ of the slit 42 is equal to the width $W_1$ of the main body 331 of the first end of the internal damper 3. In addition, the length L of the slit 42 of the clamping part 41 of the second internal damper holder 4*b* is equal to the height $H_1$ of the main body 332 of the second end of the internal damper 3, and the width $W_2$ of the slit 42 is equal to the width $W_1$ of the main body 332 of the second end of the internal damper 3. Therefore, the internal damper 3 is prevented from moving in the first direction $C_1$ or the second direction $C_2$. In addition, the raised part 341 on the first end 31 of the internal damper 3 is blocked by the clamping part 41 of the first internal damper holder 4*a*, and the raised part 342 on the second end 32 of the internal damper 3 is blocked by the clamping part 41 of the second internal damper holder 4*b*. Therefore, the internal damper is also prevented from moving in the third direction $C_3$.

Therefore, under the combined action of the first internal damper holder 4*a*, the second internal damper holder 4*b*, the raised part 341 on the first end 31 of the internal damper 3, and the raised part 342 on the second end 32 of the internal damper 3, the internal damper 3 does not move in any direction and thus is fixed within the fuel guiderail 1.

Second Embodiment of the Fuel Guiderail Assembly

Figure 10:
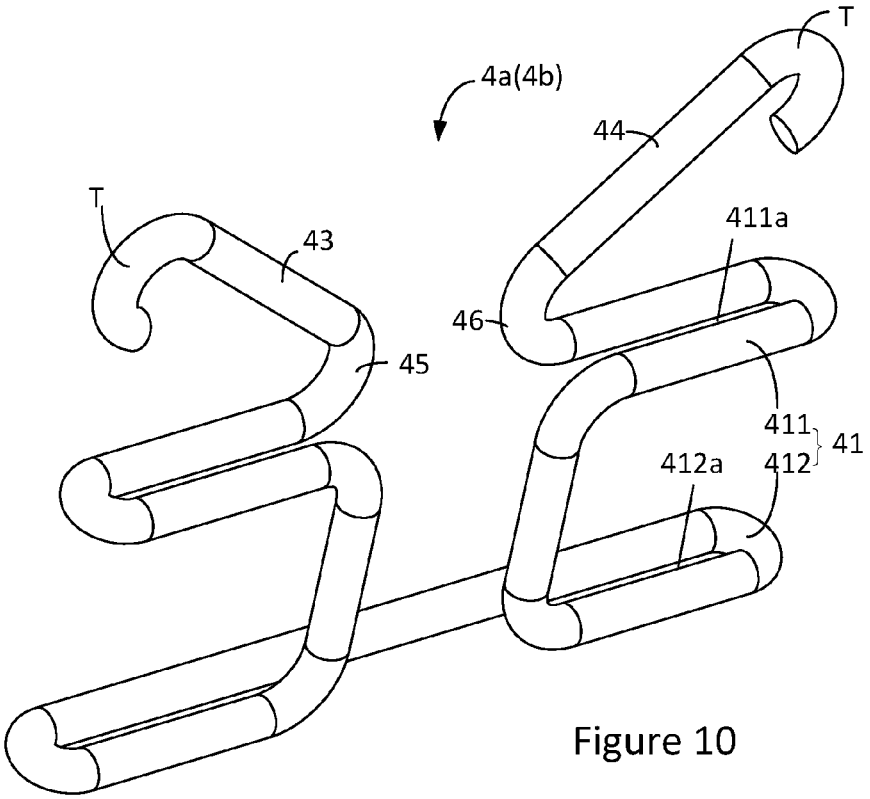
FIG. 10 is an exploded view of the internal damper holder in the second embodiment of the fuel guiderail of the present utility model.
Figure 11:
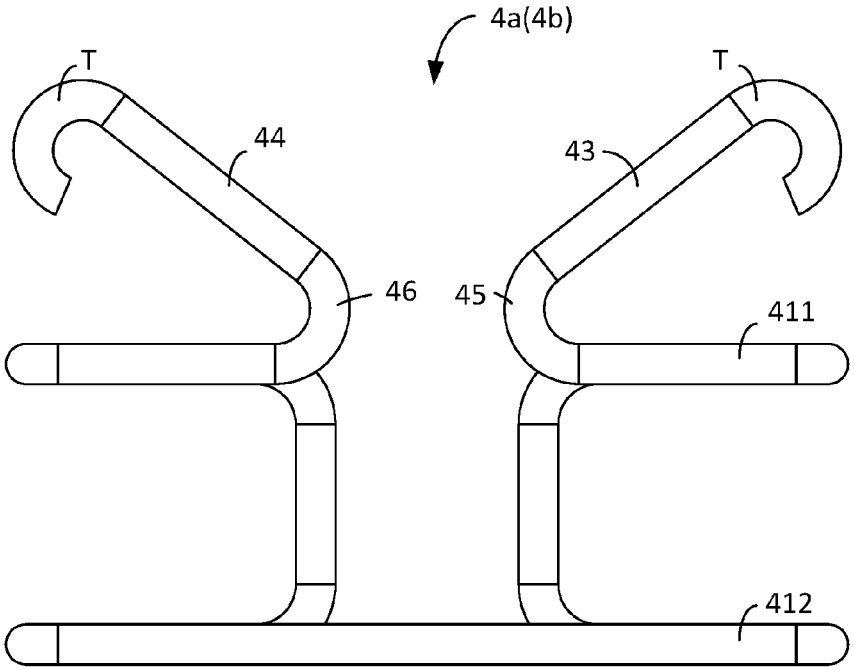
FIG. 11 is the rear view of the internal damper holder shown in FIG. 10.
Figure 12:
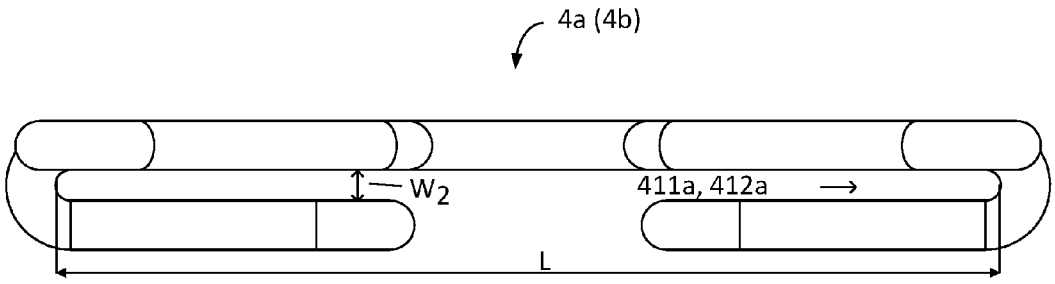
FIG. 12 is the top view of the internal damper holder shown in FIG. 10.
Figure 13:
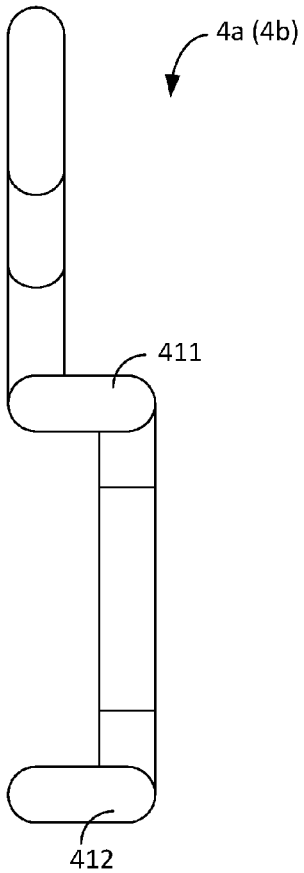
FIG. 13 is the left view of the internal damper holder shown in FIG. 10.
Figure 14:
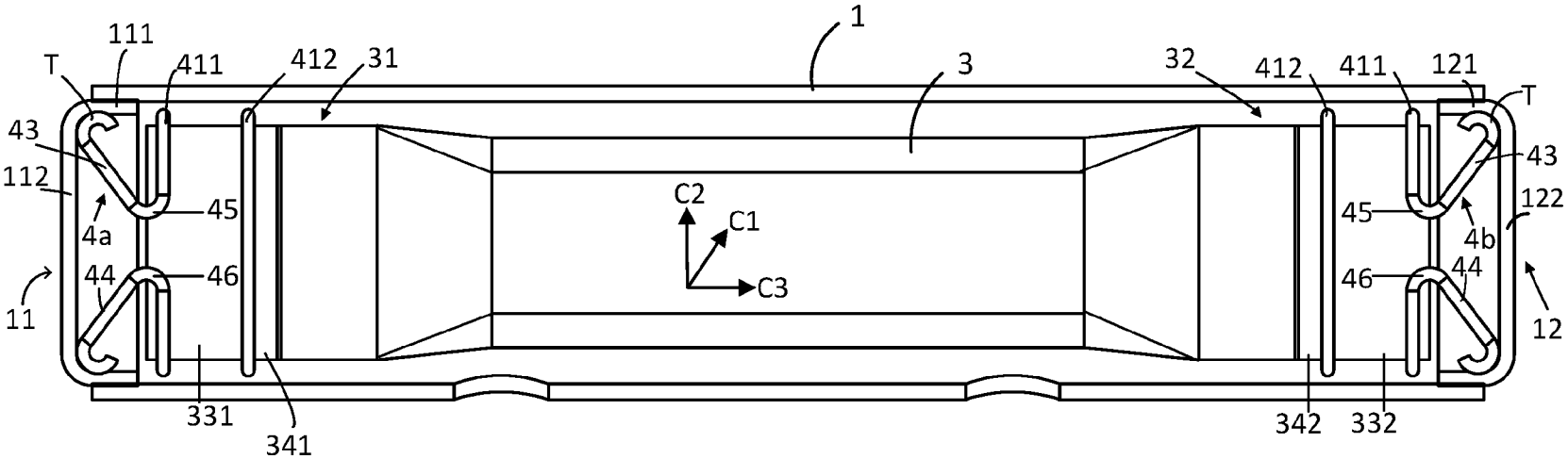
FIG. 14 and FIG. 15 are respectively the sectional view of fixing the internal damper shown in FIG. 2 and that shown in FIG. 3 inside a fuel guiderail by using the internal damper holder shown in FIG. 10.
Figure 15:
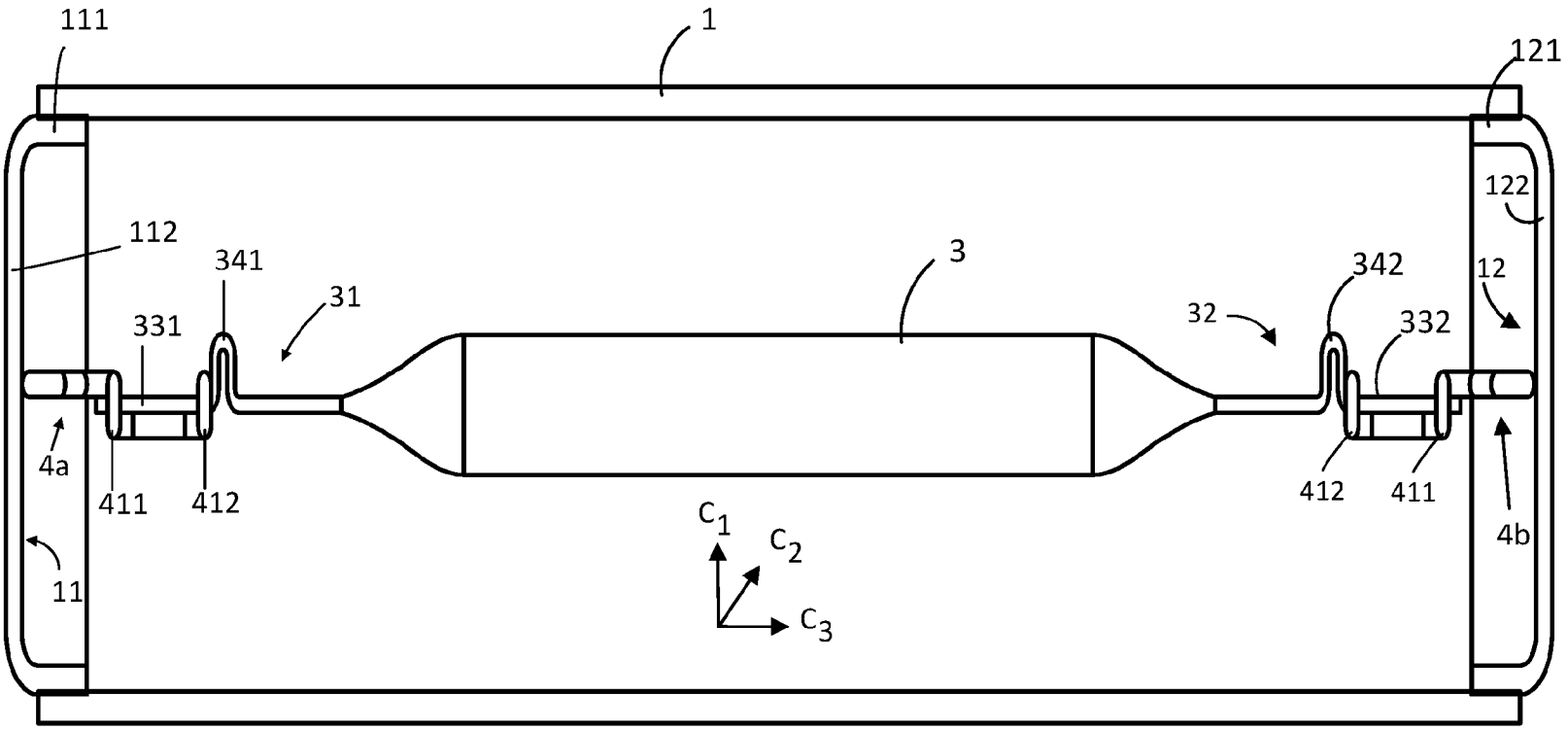

FIG. 10 shows the exploded view of the internal damper holder in the second embodiment of the fuel guiderail of the present utility model. FIG. 11 shows the rear view of the internal damper holder shown in FIG. 10. FIG. 12 shows the top view of the internal damper holder shown in FIG. 10. FIG. 13 shows the left view of the internal damper holder shown in FIG. 10. FIG. 14 and FIG. 15 are sectional views of fixing the internal damper as shown in FIG. 2 and FIG. 3 inside a fuel guiderail by using internal damper holders as shown in FIG. 10.

A comparison between FIG. 10 to FIG. 15 and FIG. 4 to FIG. 9 shows that the difference between an internal damper holder in the second embodiment and that in the first embodiment is as follows: In addition to the first clamping part 411 with slit 411*a*, the clamping part 41 of the internal damper holders 4*a* and 4*b* includes the second clamping part 412 with slit 412*a*. The first clamping part 411 and the second clamping part 412 are fixedly connected and are in parallel with and apart from each other. The first holding part 43 and the second holding part 44 are respectively fixedly connected to the first clamping part 411 through the first elastic part 45 and the second elastic part 46. In addition, the first holding part 43 and the second holding part 44 are located on the same side of the first clamping part (the side away from the raised parts 341 and 342 of the internal damper as shown in FIG. 14 and FIG. 15). That is, the second clamping part 412 is provided on one side of the first clamping part 411; the first holding part 43 and the second holding part 44 are provided on the other side of the first clamping part 411. The length L of the slit 411*a* of the first clamping part 411 and the slit 412*a* of the second clamping part 412 is equal to the height $H_1$ of the main body 331 of the first end and the main body 332 of the second end; the width $W_2$ of the slit 411*a* of the first clamping part 411 and the slit 412*a* of the second clamping part 412 is equal to the width $W_1$ of the main body 331 of the first end and the main body 332 of the second end.

In conjunction with FIG. 10, FIG. 14, and FIG. 15, the following describes a procedure of fixing an internal damper inside a fuel guiderail by using the first internal damper holder and the second internal damper holder according to this embodiment: The assembly procedure is roughly the same as that for the first embodiment, except for the above-mentioned Step 1 and Step 5. Therefore, the following describes only Step 1 and Step 5:

Step 1 Make the main body 331 of the first end of the internal damper 3 pass through in turn the slit 412*a* of the second clamping part 412 and the slit 411*a* of the first clamping part 411 of the first internal damper holder 4*a* until the second clamping part 412 is blocked by the raised part 341 on the first end 31.

Step 5 Make the main body 332 of the second end of the internal damper 3 pass through in turn the slit 412*a* of the second clamping part 412 and the slit 411*a* of the first clamping part 411 of the second internal damper holder 4*b* until the second clamping part 412 is blocked by the raised part 342 on the second end 32.

Compared with the internal damper holders in the first embodiment, the internal damper holders in the second embodiment have the following advantages: As shown in FIG. 10, FIG. 14, and FIG. 15, the first end 31 and second end 32 of the internal damper 3 can be wrapped up not only by the first clamping part 411 of the first internal damper holder 4*a* and the second internal damper holder 4*b* respectively but also by the second clamping part 412 distributed at a spacing from the first clamping part 411. Therefore, the internal damper 3 can be better prevented from moving in the first direction $C_1$ or the second direction $C_2$ and thus is more securely fixed inside the fuel guiderail 1.

Third Embodiment of the Fuel Guiderail Assembly

Figure 16:
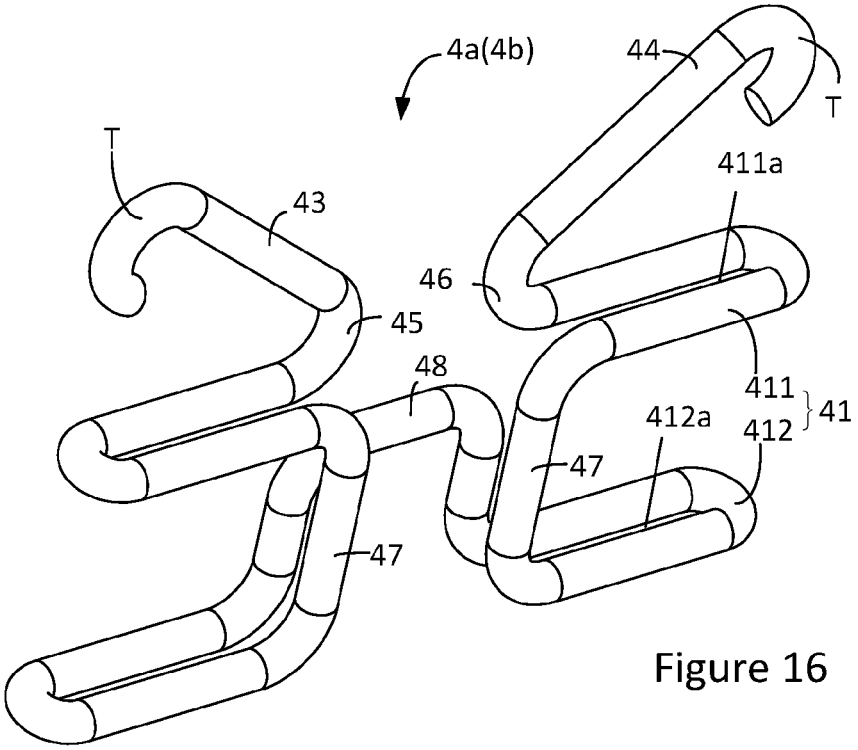
FIG. 16 is the exploded view of the internal damper holder in the third embodiment of the fuel guiderail of the present utility model.
Figure 17:
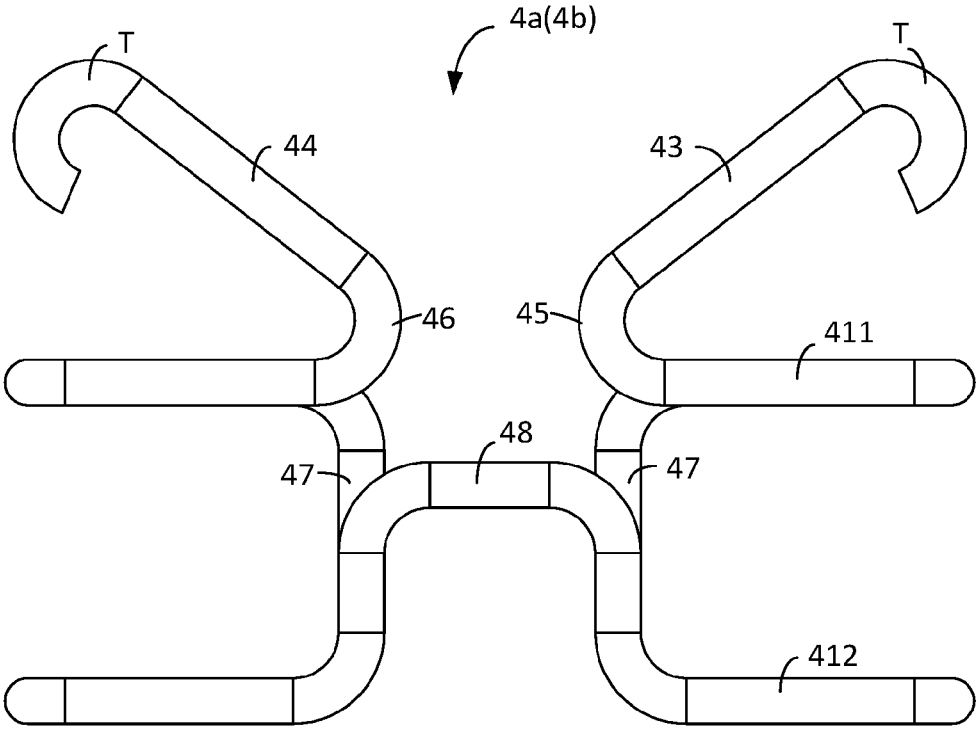
FIG. 17 is the rear view of the internal damper holder shown in FIG. 16.
Figure 18:
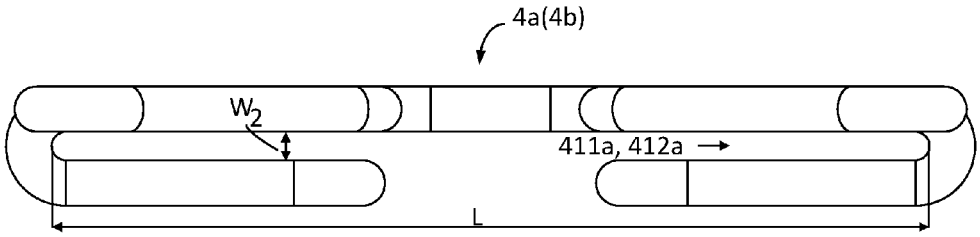
FIG. 18 is the top view of the internal damper holder shown in FIG. 16.
Figure 19:
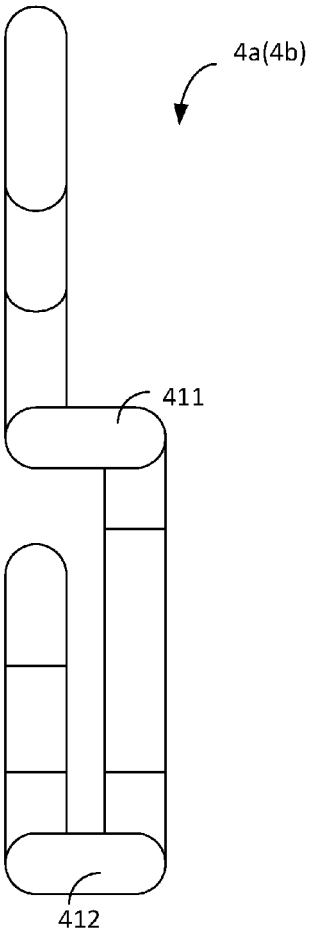
FIG. 19 is the left view of the internal damper holder shown in FIG. 16.
Figure 20:
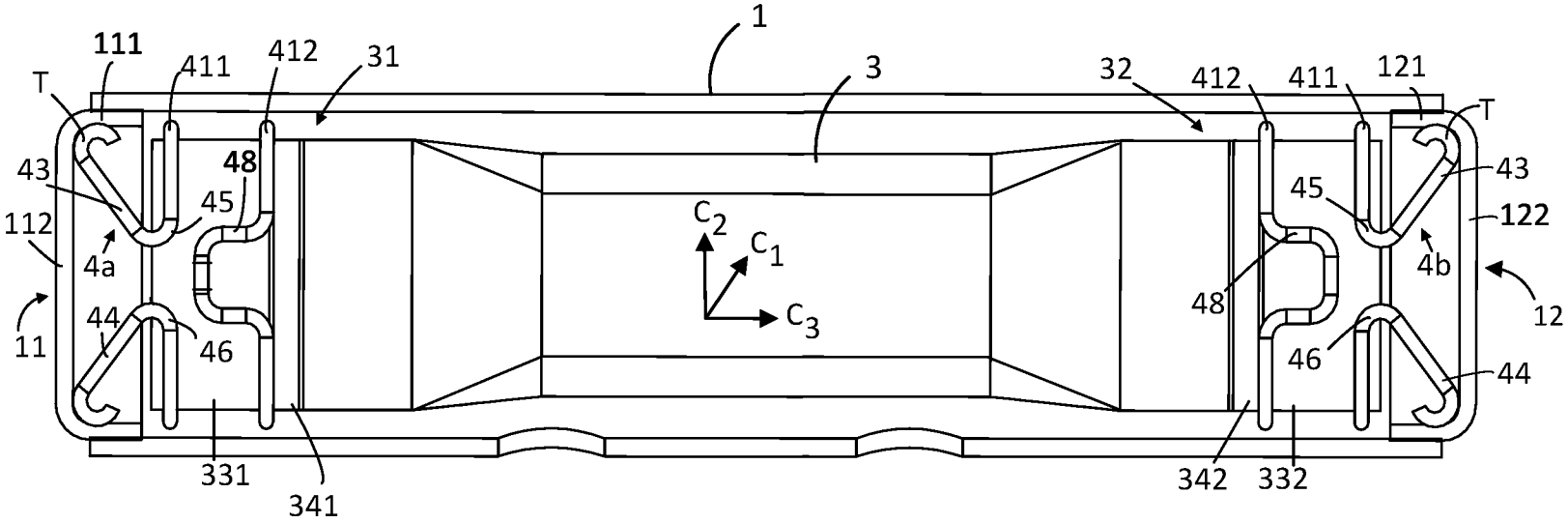
FIG. 20 and FIG. 21 are respectively the sectional view of fixing the internal damper shown in FIG. 2 and that shown in FIG. 3 inside a fuel guiderail by using the internal damper holder shown in FIG. 16.
Figure 21:
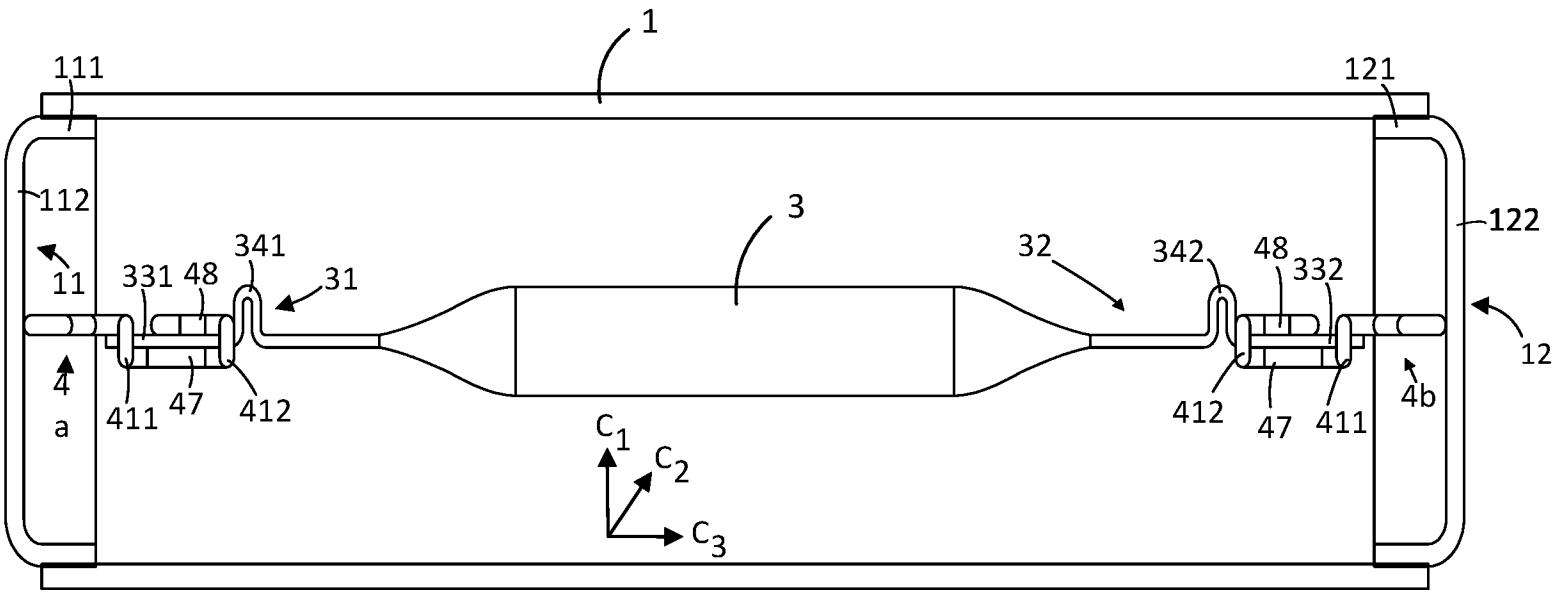
Figure 22:
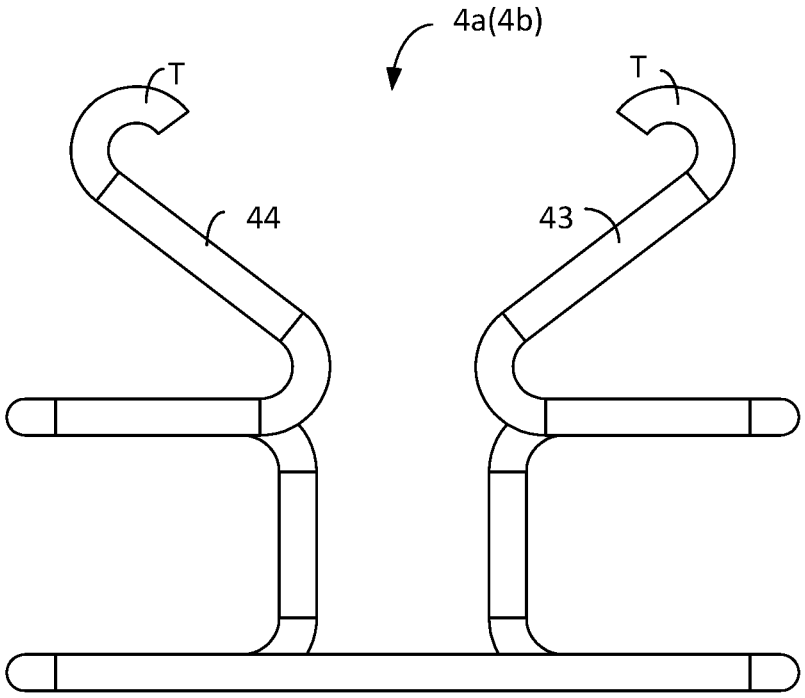
FIG. 22 is a schematic diagram of the first holding part and second holding part in an embodiment of the internal damper holder of the present utility model.

FIG. 16 shows the exploded view of the internal damper holder in the third embodiment of the fuel guiderail of the present utility model. FIG. 17 shows the rear view of the internal damper holder shown in FIG. 16. FIG. 18 shows the top view of the internal damper holder shown in FIG. 16. FIG. 19 shows the left view of the internal damper holder shown in FIG. 16. FIG. 20 and FIG. 21 are sectional views of fixing the internal dampers as shown in FIG. 2 and FIG. 3 inside a fuel guiderail by using internal damper holders as shown in FIG. 16.

A comparison between FIG. 10 and FIG. 16 shows that the differences between the internal damper holder in the third embodiment and the internal damper holder in the second embodiment are as follows: The internal damper holder in the third embodiment further comprises the first spacing part 47 and the second spacing part 48 fixed between the first clamping part 411 and the second clamping part 412. The first spacing part 47 and the second spacing part 48 are facing each other. In addition, the spacing between the first spacing part 47 and the second spacing part 48 is the same as the width of the slit 411*a* of the first clamping part 411 and the width of the slit 412*a* of the second clamping part 412. Thus, the main body 331 of the first end passes through the slit 412*a* of the second clamping part 412 and the slit 411*a* of the first clamping part 411; the main body 332 of the second end passes through the slit 412*a* of the second clamping part 412 and the slit 411*a* of the first clamping part 411. The main body 331 of the first end and the main body 332 of the second end are firmly held between the first spacing part 47 and the second spacing part 48, which further prevents the internal damper 3 from moving in the first direction $C_1$. In the present embodiment, the connection between the first clamping part 411 and the second clamping part 412 also functions as the first spacing part 47.

In conjunction with FIG. 16, FIG. 20, and FIG. 21, the following describes a procedure of fixing an internal damper inside a fuel guiderail by using the first internal damper holder and the second internal damper holder according to this embodiment. The assembly procedure is roughly the same as that in the first embodiment, except for Step 1 and Step 5. Therefore, the following describes only Step 1 and Step 5:

Step 1 Make the main body 331 of the first end of the internal damper 3 pass through in turn the slit 412*a* of the second clamping part 412 of the first internal damper holder 4*a*, the spacing between the first spacing part 47 and the second spacing part 48, and the slit 411*a* of the first clamping part 411 until the second clamping part 412 is blocked by the raised part 341 on the first end 31.

Step 5 Make the main body 332 of the second end of the internal damper 3 pass through in turn the slit 412*a* of the second clamping part 412 of the second internal damper holder 4*b*, the spacing between the first spacing part 47 and the second spacing part 48, and the slit 411*a* of the first clamping part 411 until the second clamping part 412 is blocked by the raised part 342 on the second end 32.

Compared with the internal damper holders in the second embodiment, the internal damper holders in the third embodiment have the following advantages: As shown in FIG. 16, FIG. 20, and FIG. 21, the first end 31 and second end 32 of the internal damper 3 not only can be confined by the first clamping part 411 and the second clamping part 412 but also can be blocked by the first spacing part 47 and the second spacing part 48 that are facing each other. Therefore, the internal damper 3 can be better prevented from moving in the first direction $C_1$ and thus is more securely fixed inside the fuel guiderail 1.

During the installation of the fuel guiderail assembly, the end T of the first holding part 43 and that of the second holding part 44 need to move along the side walls of the fuel guiderail 1 (see step 4 of the installation procedure for the first embodiment). To reduce the frictional force between the end T of the first holding part 43 and that of the second holding part 44 and the side walls of the fuel guiderail 1, the end T of the first holding part 43 and that of the second holding part 44 can be made arch-shaped, as shown in FIG. 4 to FIG. 22. Note that the shapes of the end T of the first holding part 43 and that of the second holding part 44 are not limited to the above-mentioned embodiments. The end T of the first holding part 43 and that of the second holding part 44 can also take other shapes that allow the ends to be securely fixed inside the first end cap 11 and the second end cap 12 and easily move along the side walls of the fuel guiderail 1.

In addition, for an internal damper to be more securely fixed inside the fuel guiderail, the clamping parts of the internal damper holders in the above-mentioned second embodiment and third embodiment of the fuel guiderail assembly further comprise other clamping parts installed on the side of the second clamping part away from the first clamping part.

As described in the above-mentioned embodiments, the first elastic part and the second elastic part must have good elastic deformation performance. In addition, internal damper holders are installed inside a fuel guiderail and therefore are often soaked in fuel. Therefore, the first elastic part and the second elastic part must not react chemically with fuel. Otherwise, the elastic deformation performance of the first elastic part and the second elastic part degrades and consequently the internal damper fails to be securely fixed inside the fuel guiderail.

As described above, when the installation of the entire fuel guiderail assembly is completed, the first elastic part 45 and the second elastic part 46 of the first internal damper holder 4*a* and the second internal damper holder 4*b* fixed in the fuel guiderail 1 are compressed. To ensure that the first elastic part 45 and the second elastic part 46 are not damaged after being subjected to long-term pressure concentration, the first elastic part 45 and the second elastic part 46 are made arch-shaped in the preferred embodiments of the present utility model.

To facilitate the manufacture of internal damper holders and fix the internal damper holders in different locations in a balanced manner, in all the preceding embodiments of internal damper holders, the internal damper holders can adopt an integrated and symmetrical butterfly structure.

In summary, the present utility model discloses a fuel guiderail assembly that comprises a fuel guiderail, a first end cap and a second end cap that are used to close the fuel guiderail, an internal damper fixed inside the fuel guiderail, a first internal damper holder and a second internal damper holder that are used to fix the internal damper inside the fuel guiderail. Said internal damper has a first end and a second end. Said first end and second end comprise a main body and a raised part provided on the main body. Said first internal damper holder and second internal damper holder comprise a clamping part with a slit and a first holding part and a second holding part respectively connected to the clamping part through the first elastic part and the second elastic part. Said first internal damper holder and second internal damper holder are respectively fixed by the first end cap and the second end cap. In addition, the main body of the first end and that of the second end of the internal damper are respectively wrapped up in the slit of the first internal damper holder and that of the second internal damper holder. Thus, the internal damper is prevented from moving in the first direction or the second direction. In addition, the raised parts on the first end and the second end of the internal damper are respectively blocked by the clamping parts of the first internal damper holder and the second internal damper holder. Thus, the internal damper is prevented from moving in the third direction. Therefore, the internal damper can be securely fixed inside the fuel guiderail.

Further, the clamping parts of the internal damper holders can be equipped with a first clamping part and a second clamping part that are spaced apart. Thus, the internal damper can be wrapped up not only by the first clamping part but also by the second clamping part. The internal damper can be better prevented from moving in the first direction or the second direction and thus is more securely fixed inside the fuel guiderail.

Further, said first internal damper holder and second internal damper holder can also comprise a first spacing part and a second spacing part located between the first clamping part and the second clamping part. Thus, the internal damper not only can be confined by the first clamping part and the second clamping part but also can be blocked by the first spacing part and the second spacing part that are facing each other. In this way, the internal damper can be better prevented from moving in the first direction and thus is more securely fixed inside the fuel guiderail.

The description of the preceding embodiments should allow those skilled in the art to better understand the present utility model and reproduce and use the present utility model. It is obvious that, based on the principles described in this document, those skilled in the art may make various improvements and modifications on the above-mentioned embodiments without departing from the spirit or scope of the present utility model. Therefore, it should be understood that the present utility model is not limited to the embodiments described herein, and the protection scope of the present utility model shall be as defined in the attached claims.

The invention claimed is:

1. An internal damper holder, which comprises:

a clamping part with a slit; and a first holding part and a second holding part, which are fixedly connected to said clamping part through a first elastic part and a second elastic part, respectively, and are set on the same side of said clamping part, wherein said first holding part includes a first end and a second end and said second holding part includes a first end and a second end, a distance between said first end of said first holding part and said clamping part is greater than a distance between said second end of said first holding part and said clamping part, a distance between said first end of said second holding part and said clamping part is greater than a distance between said second end of said second holding part and said clamping part, and a distance between said first end of said first holding part and said first end of said second holding part is greater than a distance between said second end of said first holding part and said second end of said second holding part, and wherein said first holding part and second holding part are rotatable through the first elastic part and the second elastic part, respectively.

2. The internal damper holder as described in claim 1, wherein said clamping part comprises a first clamping part, the first clamping part comprising first, second and third elongated segments and first and second connecting segments, the first, second and third elongated segments are connected to the first and second connecting segments so that the first and second elongated segments are disposed in parallel relation with the third elongated segment such that the slit is formed by a space between the first elongated segment and the third elongated segment and between the second elongated segment and the third elongated segment.

3. The internal damper holder as described in claim 1, wherein said clamping part comprises a first clamping part and a second clamping part fixedly connected to and in parallel with said first clamping part, said first clamping part and second clamping part are provided with slits, and said first holding part and second holding part are fixedly connected to the first clamping part through the first elastic part and the second elastic part, respectively.

4. The internal damper holder as described in claim 3, which further comprises a first spacing part and a second spacing part that are fixedly connected between said first clamping part and said second clamping part and are facing each other, wherein the spacing between said first spacing part and said second spacing part is equal to a width of said slits.

5. The internal damper holder as described in claim 1, wherein said first elastic part and second elastic part are arch-shaped.

6. The internal damper holder as described in claim 1, wherein the first ends of said first holding part and second holding part are arch-shaped.

7. The internal damper holder as described in claim 1, wherein said internal damper holder is an integrated and symmetrical butterfly structure.

8. The internal damper holder as described in claim 2, wherein the first elongated segment and the second elongated segment are spaced apart from each other and have the same longitudinal axis.

9. The internal damper holder as described in claim 3, wherein each of the first clamping part and the second clamping part comprises first, second and third elongated segments and first and second connecting segments, the first, second and third elongated segments are connected to the first and second connecting segments so that the first and second elongated segments are disposed in parallel relation with the third elongated segment such that the slit is formed by a space between the first elongated segment and the third elongated segment and between the second elongated segment and the third elongated segment.

10. The internal damper holder as described in claim 9, wherein the first elongated segment and the second elongated segment of the first clamping part are spaced apart from each other and have the same longitudinal axis, and wherein the first elongated segment and the second elongated segment of the second clamping part are spaced apart from each other and have the same longitudinal axis.

11. The internal damper holder as described in claim 4, wherein the first spacing part comprises a pair of elongated members disposed in parallel with each other, and the second spacing part comprises a U-shaped members having a pair of elongated members that are disposed in parallel with each other.

12. The internal damper holder as described in claim 1, wherein the first holding part and the second holding part are disposed at an angle relative to each other between 90 degrees and 180 degrees in an absence of external forces being applied to the first and second holding parts.

13. A fuel guiderail assembly, which comprises:

a fuel guiderail;

a first end cap and a second end cap fixed to both ends of said fuel guiderail;

an injector that is installed on said fuel guiderail and connected to said fuel guiderail;

an internal damper fixed inside said fuel guiderail, wherein said internal damper is provided with a first end and a second end, and each said first end and said second end comprises a main body and a raised part provided on the main body; and a first internal damper holder and a second internal damper holder holding the internal damper inside the fuel guiderail, each of the first and second internal damper holders comprising:

a clamping part with a slit;

a first holding part and a second holding part which are fixedly connected to said clamping part through a first elastic part and a second elastic part, respectively, and are set on the same side of said clamping part, wherein said first holding part includes a first end and a second end and said second holding part includes a first end and a second end, a distance between said first end of said first holding part and said clamping part is greater than a distance between said second end of said first holding part and said clamping part, a distance between said first end of said second holding part and said clamping part is greater than a distance between said second end of said second holding part and said clamping part, and a distance between said first end of said first holding part and said first end of said second holding part is greater than a distance between said second of said first holding part and said second end of said second holding part, and wherein said first holding part and second holding part are rotatable through the first elastic part and the second elastic part, respectively, wherein the first holding part and the second holding part of each said first internal damper holder and said second internal damper holder are respectively fixed to said first end cap and second end cap, the main body of the first end and the second end of said internal damper are respectively confined within the slits of the clamping parts of said first internal damper holder and second internal damper holder, and the raised parts of the first end and second end of said internal damper are respectively blocked by the clamping parts of said first internal damper holder and second internal damper holder.

14. The fuel guiderail assembly as described in claim 13, wherein the lengths of the slits of said first internal damper holder and said second internal damper holder are equal to the heights of said main bodies of the first end and the second end of the internal damper, respectively; the widths of the slits of said first internal damper holder and said second internal damper holder are equal to the thicknesses of said main bodies of the first end and the second end of the internal damper, respectively.

15. The fuel guiderail assembly as described in claim 13, wherein said raised parts are U-shaped, V-shaped, rectangular, or arch-shaped.

16. The fuel guiderail assembly as described in claim 13, wherein for each of the first internal damper holder and the second internal damper holder, the clamping part comprises a first clamping part and a second clamping part fixedly connected to and in parallel with said first clamping part, said first clamping part and said second clamping part are provided with slits, and said first holding part and said second holding part are fixedly connected to the first clamping part through the first elastic part and the second elastic part, respectively.

17. The fuel guiderail assembly as described in claim 16, wherein for each of the first internal damper holder and the second internal damper holder, the internal damper holder further comprises a first spacing part and a second spacing part that are fixedly connected between said first clamping part and said second clamping part of the internal damper holder and are facing each other, wherein the spacing between said first spacing part and said second spacing part is equal to a width of the slits.

18. The guiderail assembly as described in claim 13, wherein for each of the first internal damper holder and the second internal damper holder, the clamping part comprises first, second and third elongated segments and first and second connecting segments, the first, second and third elongated segments are connected to the first and second connecting segments so that the first and second elongated segments are disposed in parallel relation with the third elongated segment such that the slit of the clamping part is formed by a space between the first elongated segment and the third elongated segment and between the second elongated segment and the third elongated segment.

19. The guiderail assembly as described in claim 13, wherein for each of the first internal damper holder and the second internal damper holder, the first holding part and the second holding part are disposed at an angle relative to each other between 90 degrees and 180 degrees in an absence of external forces being applied to the first and second holding parts.

* * * * *